US011696603B2

(12) United States Patent
Liu

(10) Patent No.: US 11,696,603 B2
(45) Date of Patent: Jul. 11, 2023

(54) HEATING CUP, HIGH FREQUENCY HEATING UNIT, AND HOOKAH

(71) Applicant: Shenzhen Eigate Technology Co., Ltd., Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 378 days.

(21) Appl. No.: 17/037,619

(22) Filed: Sep. 29, 2020

(65) Prior Publication Data

US 2021/0360973 A1 Nov. 25, 2021

(30) Foreign Application Priority Data

May 21, 2020 (CN) ..... 202010435846.3
May 21, 2020 (CN) ..... 202020863100.8

(51) Int. Cl.

| | |
|---|---|
| ***A24F 40/465*** | (2020.01) |
| ***A24F 1/30*** | (2006.01) |
| ***A24F 1/02*** | (2006.01) |
| ***A24F 1/32*** | (2006.01) |
| ***A24F 5/00*** | (2006.01) |

(52) U.S. Cl.

CPC ..... *A24F 40/465* (2020.01); *A24F 1/02* (2013.01); *A24F 1/30* (2013.01); *A24F 1/32* (2013.01); *A24F 5/00* (2013.01)

(58) Field of Classification Search

CPC ..... A24F 1/02; A24F 1/30; A24F 1/32; A24F 5/00; A24F 40/465

See application file for complete search history.

(56) References Cited

U.S. PATENT DOCUMENTS

2017/0251718 A1* 9/2017 Armoush et al. ..... A24F 1/30

FOREIGN PATENT DOCUMENTS

WO WO 2018/220558 A1 * 12/2018 ..... A24F 7/00

* cited by examiner

*Primary Examiner* — Michael J Felton
*Assistant Examiner* — Ronnie Kirby Jordan
(74) *Attorney, Agent, or Firm* — Matthias Scholl P.C.; Matthias Scholl

(57) ABSTRACT

A heating cup, including a heating container configured to be heated by a high frequency heating unit. When in use, the high frequency heating unit is disposed around the heating container; in a power-on state, the heating container is configured to produce heat under the action of the high frequency heating unit to heat a tobacco material and produce smoke.

8 Claims, 5 Drawing Sheets

HEATING CUP, HIGH FREQUENCY HEATING UNIT, AND HOOKAH

CROSS-REFERENCE TO RELATED APPLICATIONS

Pursuant to 35 U.S.C. § 119 and the Paris Convention Treaty, this application claims foreign priority to Chinese Patent Application No. 202010435846.3 filed on May 21, 2020, and to Chinese Patent Application No. 202020863100.8 filed on May 21, 2020. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to a heating cup, a high frequency heating unit, and a hookah.

A conventional tobacco material heating device comprises a heating cup and a magnetic induction coil fixedly disposed on the heating cup. The heating cup is made of metal or plastics.

SUMMARY

The disclosure provides a heating cup, comprising a heating container configured to be heated by a high frequency heating unit; when in use, the high frequency heating unit is disposed around the heating container; in a power-on state, the heating container is configured to produce heat under the action of the high frequency heating unit to heat a tobacco material and produce smoke In a class of this embodiment, the heating cup further comprises an air inlet nozzle; the air inlet nozzle comprises a first air passage communicating with the heating container.

In a class of this embodiment, an airflow volume of the air inlet nozzle is changeable through covering a part of the air inlet nozzle with a finger.

In a class of this embodiment, the air inlet nozzle is made of ceramic material.

In a class of this embodiment, the heating container is an integrated structure comprising glass inlaid with metal.

In a class of this embodiment, the heating container comprises a second air passage separated from the metal.

Also provided is a high frequency heating unit, comprising a magnetic induction coil and a battery, wherein the battery comprises a power panel comprising an LC circuit configured to convert a boosted DC voltage and current into an alternating current; when the alternating current passes through the magnetic induction coil, an alternating magnetic field is generated.

The high frequency heating unit further comprises a hollow handle and a hollow annular structure; the battery is disposed in the hollow handle, and the magnetic induction coil is disposed in the hollow annular structure.

A hookah comprises a heating cup and a high frequency heating unit; the high frequency heating unit comprises a magnetic induction coil and a battery; the battery comprises a power panel comprising an LC circuit configured to convert a boosted DC voltage and current into an alternating current; when the alternating current passes through the magnetic induction coil, an alternating magnetic field is generated; when in use, the high frequency heating unit is disposed around the heating container; in a power-on state, the heating container is configured to produce heat under the action of the high frequency heating unit to heat a tobacco material and produce smoke.

The hookah further comprises a water filter; when in use, the smoke is filtered by the water filter and then inhaled by a user.

DETAILED DESCRIPTION

To further illustrate, embodiments detailing a heating cup and a high frequency heating unit are described below. It should be noted that the following embodiments are intended to describe and not to limit the disclosure.

Tobacco materials refer to smoke oil, tobacco, tobacco and other materials used to produce smoke.

The disclosure provides a heating cup in combination with a water filter for use.

Figure 1:
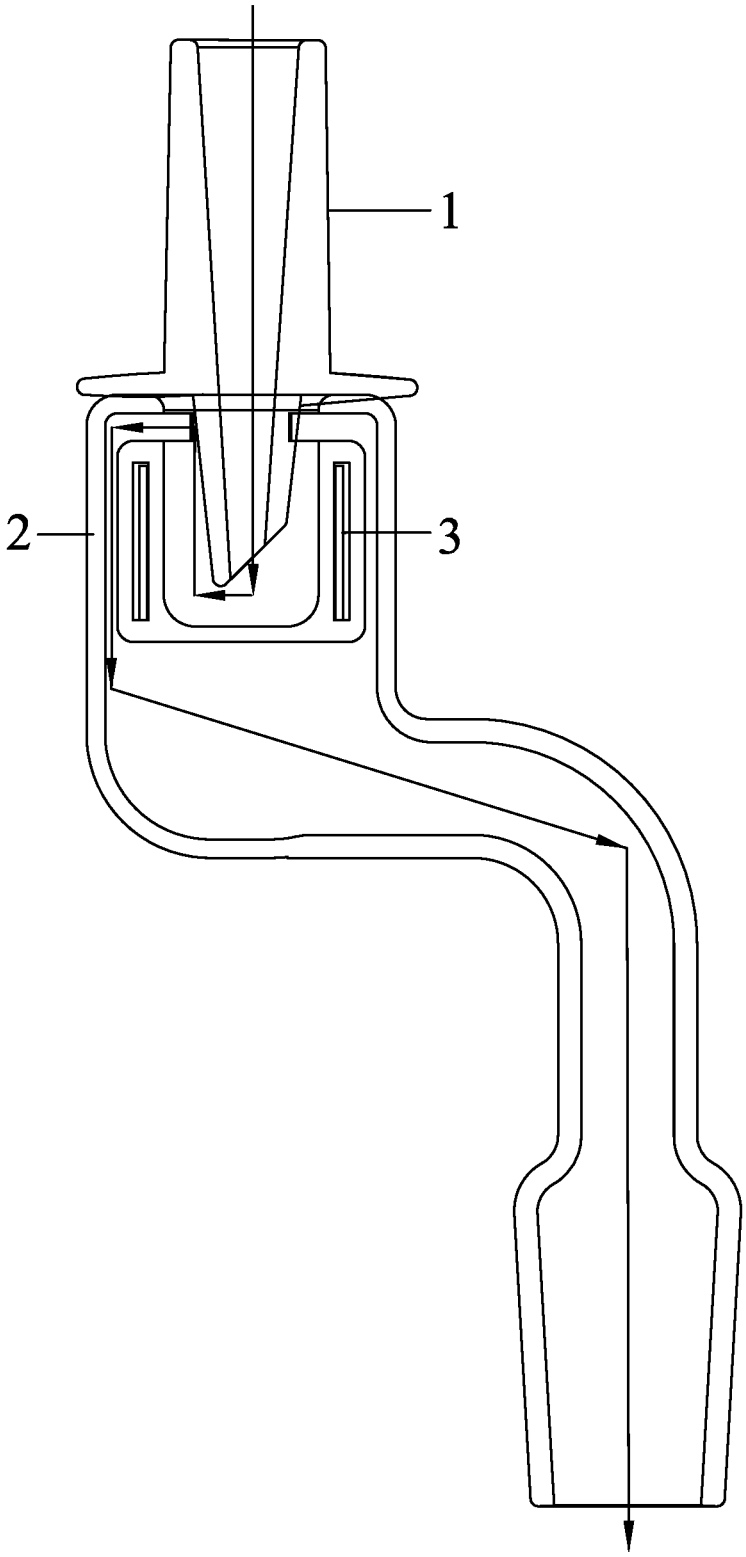
FIG. 1 is a sectional view of a heating cup in accordance with one embodiment of the disclosure.
Figure 2:
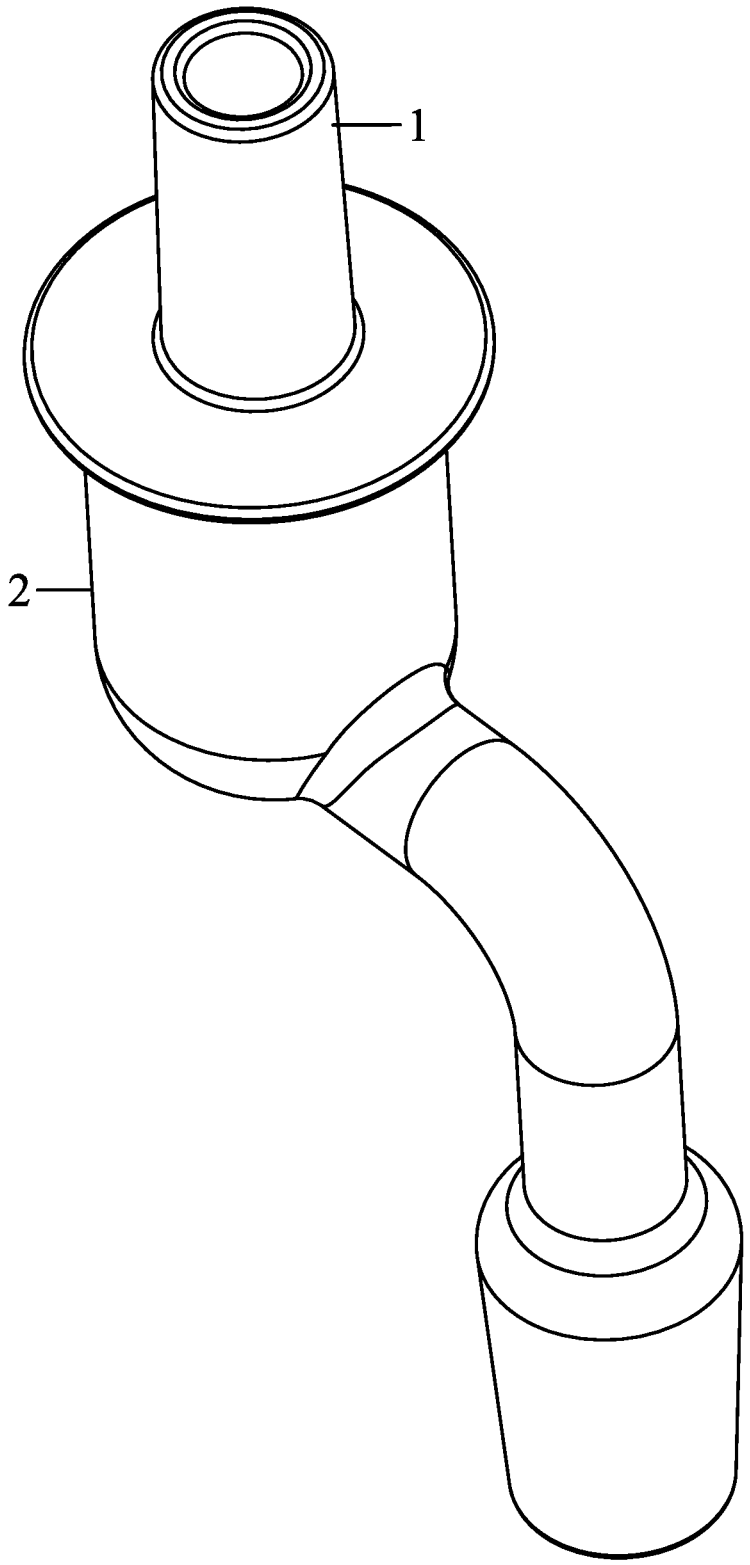
FIG. 2 is a schematic diagram of a heating cup in accordance with one embodiment of the disclosure.

Specifically, as shown in FIGS. 1-2, the heating cup comprises an air inlet nozzle 1, a heating container 2, a metal conductor 3 inlaid in the heating container 2. The air inlet nozzle 1 is disposed on the top of the heating container 2. The metal conductor 3 is inlaid in the heating container 2 and when being heated, the metal conductor exchanges heat with the heating container 2 to heat the tobacco material in the heating container 2. The air inlet nozzle 1 is made of ceramic material, and the heating container 2 is made of glass inlaid metal conductor 3.

The air inlet nozzle 1 is made of ceramic, quartz, crystal, mica and jade, which is thermally insulated and will not burn the hand in case the hand touches the air inlet nozzle.

The heating container 2 is entirely a metal or a part of it is a metal, or glass material or ceramic, quartz, crystal, mica, jade material inlaid with a metal.

Figure 3:
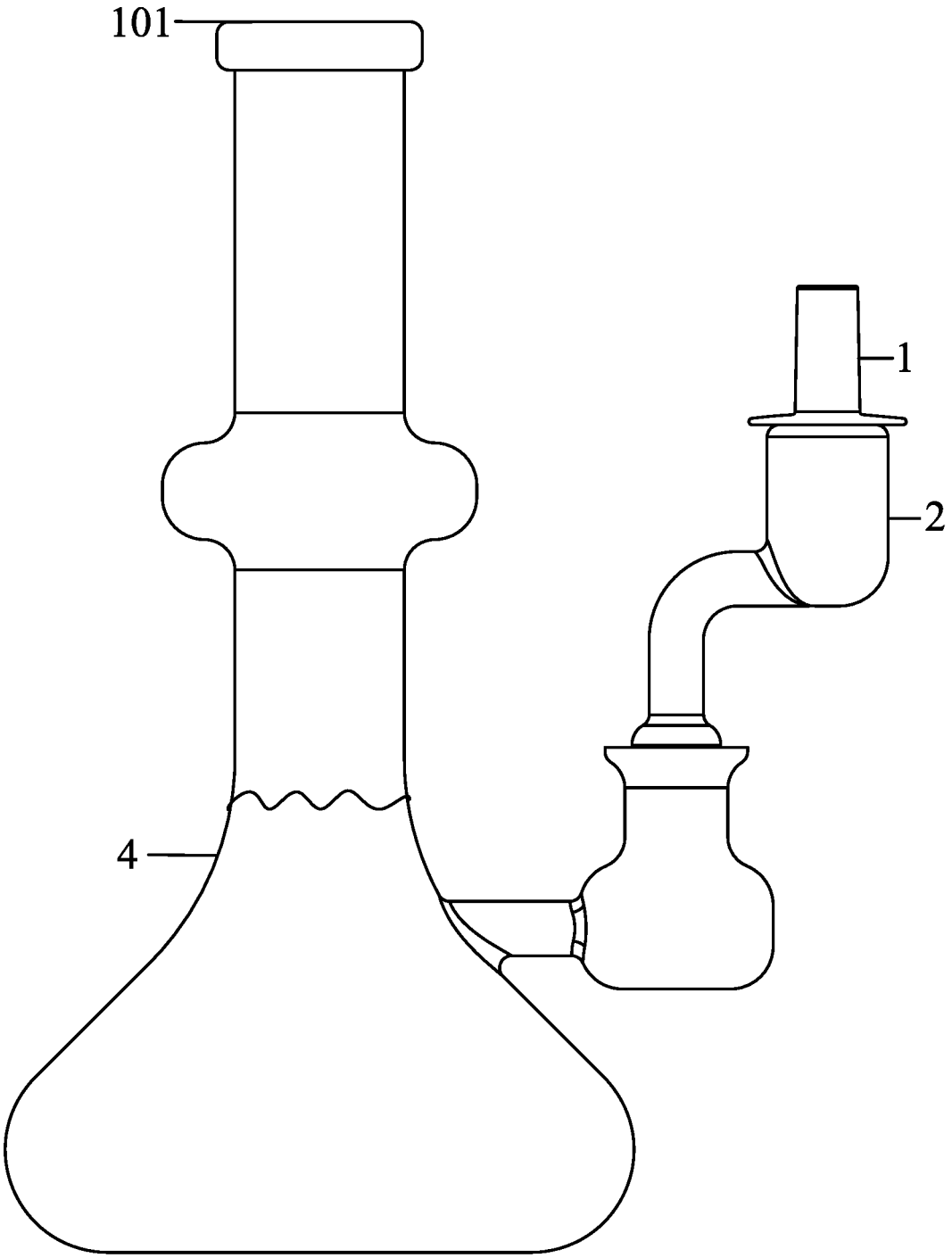
FIG. 3 shows a connection of a heating cup and a water filter in accordance with one embodiment of the disclosure.

As shown in FIG. 3, provided is a water filter used in combination with the heating cup.

Figure 4:
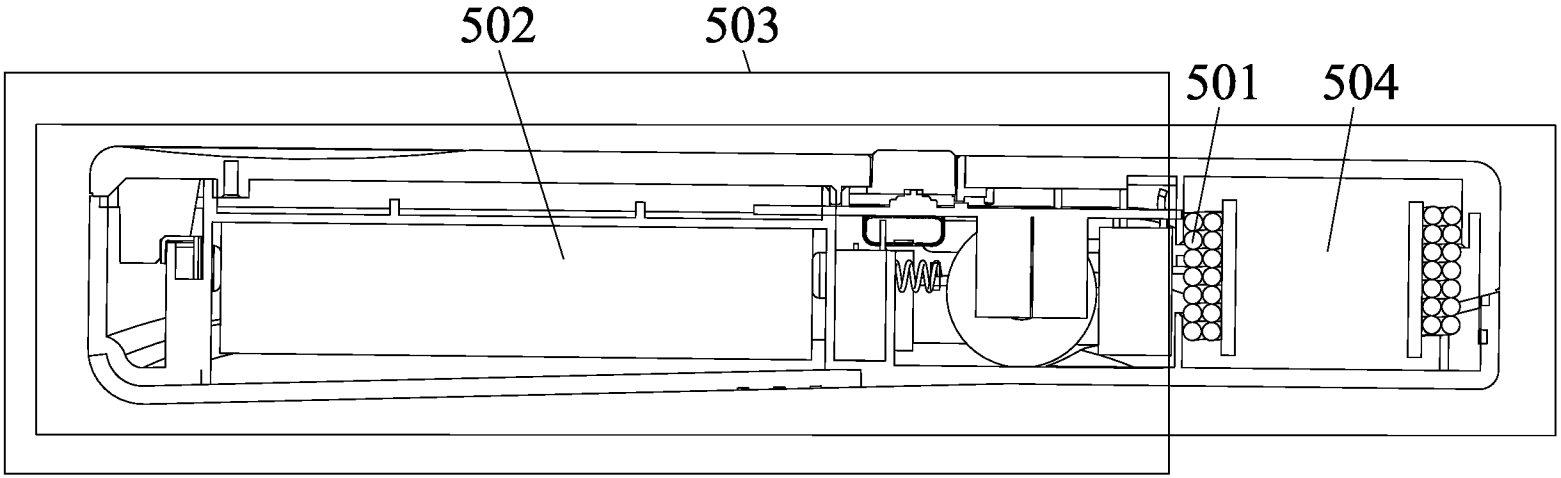
FIG. 4 is a sectional view of a high frequency heating unit in accordance with one embodiment of the disclosure.

As shown in FIG. 4, provided is a high frequency heating unit used in combination with the heating cup. The high frequency heating unit comprises a magnetic induction coil 501 and a battery 502; the battery 502 comprises a power panel comprising an LC circuit configured to convert a boosted DC voltage and current into an alternating current; when the alternating current passes through the magnetic induction coil, an alternating magnetic field is generated. The high frequency heating unit further comprises a hollow handle 503 and a hollow annular structure; the battery 502 is disposed in the hollow handle, and the magnetic induction coil 501 is disposed in the hollow annular structure.

Figure 5:
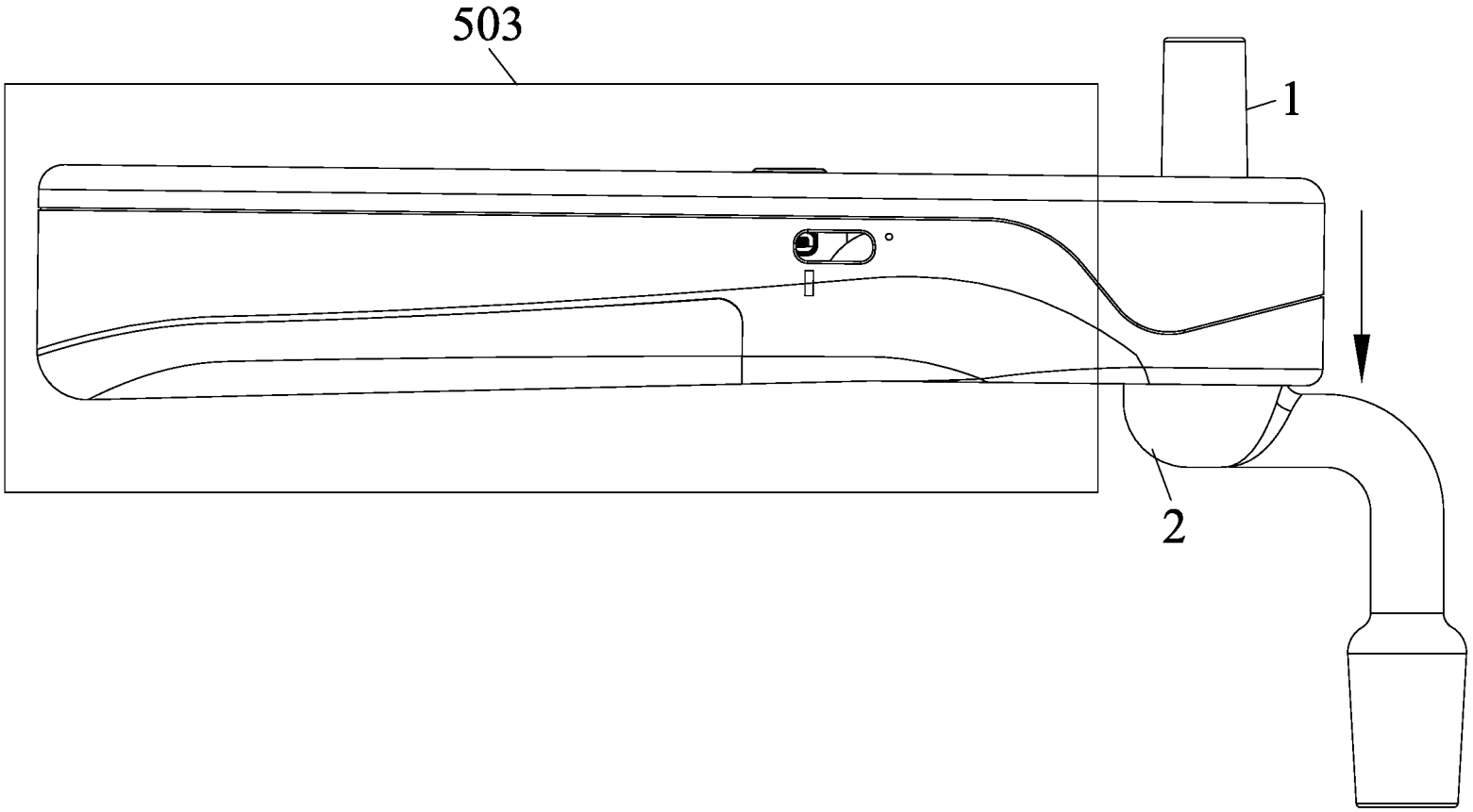
FIG. 5 shows a connection of a heating cup and a high frequency heating unit in accordance with one embodiment of the disclosure.

As shown in FIG. 5, in use, a user holds the hollow handle 503 of the high frequency heating unit. The high frequency heating unit comprises a heating part 504 corresponding to the metal conductor 3 inlaid in the heating container 2. In a power-on state, the heating container 2 produces heat under the action of the high frequency heating unit to heat a tobacco material and produce smoke. The air enters the heating container 2 via the air inlet nozzle 1 and drives the produced smoke to submerge into the water of the water filter 4 via the second air passage of the heating container 2, where the smoke is filtered, flows to a smoke outlet 101 of the water filter, and is inhaled by a user.

It will be obvious to those skilled in the art that changes and modifications may be made, and therefore, the aim in the appended claims is to cover all such changes and modifications.

What is claimed is:

1. A heating unit comprising a magnetic induction coil, a battery, a hollow handle and a hollow annular structure; wherein:

the battery comprises a power panel comprising an LC circuit configured to convert a boosted DC voltage and current into an alternating current when the alternating current passes through the magnetic induction coil, an alternating magnetic field is generated;

the battery is disposed in the hollow handle, and the magnetic induction coil is disposed in the hollow annular structure.

2. A hookah, comprising a heating cup and the heating unit of claim 1; wherein:

the heating cup comprises a heating container configured to be heated by the heating unit; and the heating unit is disposed around the heating container; in a power-on state, the heating container is configured to produce heat under the action of the heating unit to heat a tobacco material and produce smoke.

3. The hookah of claim 2, wherein the heating cup further comprises an air inlet nozzle; and the air inlet nozzle comprises a first air passage communicating with the heating container.

4. The hookah of claim 3, wherein an airflow volume of the air inlet nozzle is changeable through covering a part of the air inlet nozzle with a finger.

5. The hookah of claim 4, wherein the air inlet nozzle is made of ceramic material.

6. The hookah of claim 5, wherein the heating container is an integrated structure comprising glass inlaid with metal.

7. The hookah of claim 6, wherein the heating container comprises a second air passage separated from the metal.

8. The hookah of claim 2, further comprising a water filter; wherein when in use, the smoke is filtered by the water filter and then inhaled by a user.

* * * * *